United States Patent [19]

Larigaldie

[11] 4,417,293

[45] Nov. 22, 1983

[54] METHODS AND APPARATUS FOR TRANSFERRING ELECTRIC CHARGES OF DIFFERENT SIGNS INTO A SPACE ZONE, AND APPLICATION TO STATIC ELECTRICITY ELIMINATORS

[75] Inventor: Serge Larigaldie, Chatenay Malabry, France

[73] Assignee: Office National d'Etudes et de Recherches Aerospatiales, France

[21] Appl. No.: 309,374

[22] Filed: Oct. 7, 1981

[30] Foreign Application Priority Data

Oct. 14, 1980 [FR] France ..... 80 21977

[51] Int. Cl.[3] ..... H05F 1/00

[52] U.S. Cl. ..... 361/212; 361/228; 361/235

[58] Field of Search ..... 361/212, 213, 215, 227, 361/228, 231, 235

[56] References Cited

U.S. PATENT DOCUMENTS

| | | | |
|---|---|---|---|
| 3,083,318 | 3/1963 | Hanscom | 361/213 X |
| 3,271,483 | 9/1966 | Phillipson et al. | 361/212 X |
| 3,600,632 | 8/1971 | Bright et al. | 361/218 |
| 3,795,839 | 3/1974 | Walberg | 361/228 |
| 3,821,603 | 6/1974 | De La Cierva | 361/228 X |
| 3,863,108 | 1/1975 | Blythe et al. | 361/212 |
| 4,228,479 | 10/1980 | Larigaldie et al. | 361/228 |

FOREIGN PATENT DOCUMENTS

| | | | |
|---|---|---|---|
| 446956 | 12/1974 | U.S.S.R. | 361/213 |
| 439078 | 1/1975 | U.S.S.R. | 361/212 |
| 480202 | 1/1976 | U.S.S.R. | 361/213 |

OTHER PUBLICATIONS

"A New Device for the Neutralization of Static Electricity on Pulverulent Materials"–Larigaldie et al., Journal of Electrostatics, May 1981.

*Primary Examiner*—Harry E. Moose, Jr.
*Attorney, Agent, or Firm*—Kane, Dalsimer, Kane, Sullivan and Kurucz

[57] ABSTRACT

In a supersonic nozzle, a current of compressed air charged with humidity is expanded to produce an aerosol of ice micro-particles. A corona discharge is maintained at the neck of the nozzle at the tip of a tapered electrode by a high alternating current voltage supply connected between the electrode and the nozzle body. The alternately positive and negative ions produced by the discharge are trapped by the ice micro-particles and ejected by an orifice at the front of the nozzle out of the enclosure in the direction of a space zone the concentration in charges of different signs of which it is desired to raise. The electric supply comprises a capacitor in the circuit between the electrode and a conductive guard ring which is embedded in the body of the nozzle behind the insulating surface thereof. Thus fluxes of positive and negative particles which are overall balanced are obtained at the exit of the nozzle. The apparatus is well adapted to the elimination of static charges of electrified bodies.

11 Claims, 8 Drawing Figures

METHODS AND APPARATUS FOR TRANSFERRING ELECTRIC CHARGES OF DIFFERENT SIGNS INTO A SPACE ZONE, AND APPLICATION TO STATIC ELECTRICITY ELIMINATORS

BACKGROUND OF THE DISCLOSURE

The present invention relates to techniques permitting of modifying the electric charge of a space zone.

Processes are known for creating an electric charge of specific sign in a space zone, by favouring a concentration of ions of the same sign there. It is also known that in certain situations, in place of seeking to charge a space zone according to a specific polarity, it is useful to raise its degree of ionisation but not its overall charge, by simultaneously increasing its concentration with positive and negative charges.

The elimination of static electricity accumulated on an electrified body represents one case of application of this latter technique. In fact when such a body is plunged into a medium containing positive and negative charges, the electric field created by this body attracts the electric charges of contrary polarity which come to neutralize the charges accumulated on the body, and repels the charges of the same polarity as the electrified body.

The problem of elimination of electrostatic charges assumes great importance in various fields. Numerous bodies have in fact a tendency to accumulate positive or negative electric charges, either by influence, when they are disposed in an electric field, or under the effect of mechanical friction exerted between surfaces of different natures. When these bodies are insulators, or when they are conductive but not earthed, the charges tend to accumulate on these bodies in order to bring them to potentials which can sometimes reach extremely high values. These electrification phenomena are responsible for a certain number of damage effects which can be of mechanical order, for example sticking effects, or of electrical nature, such as the risks of electric shock for the personnel handling electrified bodies or the risks of sparking followed by explosion in inflammable media, the appearance of discharges which fog photographic films, etc.

Various types of electric charge eliminators based upon the principle of a combination of charges of a medium surrounding the body with charges of opposite sign accumulated thereon have already been proposed and utilised.

Among these devices mention may be made of radioactive eliminators which make use of the ionising properties of alpha and beta radiations to ionise slightly the air surrounding a body to be discharged. The efficacity of these devices is low by reason of the low degree of ionisation which one may hope to achieve without use of powerful radioactive sources (several tens of millicuries), the potential dangers of which, both as regards the risks of irradiation of the personnel and the risks of accidental dispersion of radioactive material, are not acceptable in numerous applications.

Corona effect eliminators also exist of the inductive type which are constituted by one or more conductive wires at earth potential fitted with points which are disposed in the proximity of the electrified bodies to be discharged. The high value of the electric field in the vicinity of the points favours the transference of charges between the electrified body and the eliminator.

Further corona effect eliminators make use of a high voltage electric source which creates an intense electric field in the vicinity of one or more points plunged into a gaseous medium in order to cause the formation of a corona discharge therein, generating ions. The produced high voltage is alternating so as alternately to produce positive and negative ions in the medium surrounding the electrified body to be neutralised.

It has however been observed that even these corona-effect eliminators suffered from inadequacies, and in certain cases could present dangers.

In particular it has been recognised that the devices utilised hitherto function effectively only when they are disposed in the immediate vicinity of the object to be discharged. Otherwise the formed ions tend to re-combine, by reason of their great mobility, before they have been able to come into contact with the body, this occurring the more rapidly as the level of ionisation which it is sought to create about the body is higher. It has further been observed that neutralisation was often imperfect or even in certain cases the body tended to acquire a charge of sign opposite to that which it had before the use of the eliminator.

Moreover the use of this type of eliminator must be banned in inflammable or explosive media since the corona discharges can give rise to sparks adapted to provoke ignition of the medium then in which they take place.

Finally it is known that corona discharges in air are accompanied by the formation of ozone, a highly oxidizing gas capable of deteriorating certain materials or presenting harmful effects for persons. This phenomenon is sometimes an obstacle to the use of corona-effect discharge eliminators.

OBJECTS AND SUMMARY

The invention has the object of supplying a means of modifying the concentration of a space zone simultaneously in positive and negative electric charges, which especially when it is applied to the atmosphere surrounding an electrified body permits of effectively neutralizing the latter.

According to the invention, in a process for modifying the concentration of a space zone in electric charges, a corona discharge is produced of alternately positive and negative polarity in an enclosure containing a gas under pressure and a condensable substance, this gas is expanded at the exit of this enclosure in such manner than the alternately positive and negative ions formed by the discharge in this gas are entrained out of the enclosure by micro-particles resulting from the condensation of the said substance in order to be transferred into the space zone, and any disequilibrium or imbalance between the currents of positive and negative charges thus produced at the exit of this enclosure is detected in order to modify the supply of the corona discharge in response to this disequilibrium.

The ions produced by the corona discharge constitute nuclei on which micro-particles of the condensable substance form. The ions are thus trapped by the current of micro-particles and they are then liberated by a change of phase of the micro-particles in order to form the charge of the space zone. By virtue of the speed acquired by the micro-particles it is possible to charge a space zone at a relatively great distance from the enclosure within which the transferred ions are created.

Moreover the mobility of non-gaseous micro-particles, even of very small dimensions, is always much less in practice than that of the ions which can be generated by the corona discharge. The result is that the probability of interaction and re-combination of the charges under the effect of the diffusion of the said micro-particles is much less than in the case of free ions.

However it has been observed that prior corona-effect ion generator devices had a different yield according to whether the electric field applied to generate the discharge was positive or negative.

Thus devices of the prior art which make use of corona discharges supplied by alternating voltages do not truly permit of obtaining fluxes of charges of opposite signs the overall neutrality of which is respected. The disequilibrium or imbalance between the fluxes of positive and negative charges thus created does not, in the absence of particular precautions, permit of obtaining neutralisation of electrical bodies in the case of application to the elimination of electrostatic particles. On the contrary this disequilibrium disturbs attempts at neutralisation, even rendering them dangerous, to the extent that the object to be discharged can charge itself up under the effect of the unbalance current.

One might have thought of simply eliminating the continuous component of the overall charge current thus produced by filtration, for example with the aid of a capacitor. Experience has shown that such action was not effective to solve the set problem. Such a capacitor is in fact shunted by the charge current circulating between the electrodes utilised to produce the discharge. According to one form of embodiment the invention therefore proposes means permitting of preventing such a current from counteracting the action taken to supply the negative corona discharges and the positive corona discharges by applying voltages differing in absolute value to the electrodes.

According to one particularly advantageous aspect of the invention, this process is carried out with the aid of a device comprising a body limiting a nozzle to expend the gas at the exit of an enclosure and a tapered electrode is placed in this enclosure in such manner that its point terminates at the neck of the nozzle, supply means being provided to establish between this electrode and the body of the nozzle and a sufficient alternating voltages to produce a corona-effect discharge in the gas expanded in the nozzle in the vicinity of the point of the tapered electrode, and the surface of the nozzle within the enclosure being electrically insulating in such manner as to block any circulation of electric current between the point and the nozzle without however preventing the establishment of an electric field sufficient for the formation or discharges producing positive and negative ions alternately.

It is further advantageously proposed to mount a capacitor device in the electric circuit connecting the tapered electrode and the nozzle. The level of charge of this device is then established at a value such that the supply voltages of the positive discharge and the negative discharge are different and respectively produce fluxes of positive and negative ions with equal outputs.

The body of the nozzle can advantageously be a block of insulating material the internal surface of which is suitably shaped from the aerodynamic viewpoint, and in which a conductor is embedded, which is connected to the alternating supply source of the assembly comprising the tapered electrode and nozzle, for example through earth.

The process and device as defined above thus permit of obtaining very high balanced concentrations of simultaneously positive and negative charges at relatively considerable distances from the enclosure where the ions arise, without re-combinations of charges becoming excessive in the course of transference.

It has been observed in particular that overall neutral flows of charges of opposite signs were obtained with significant efficiency by the use of air charged with humidity, even slightly, as compressed gas. It is further noteworthy that this form of embodiment is not accompanied by an appreciable transference of ozone in the direction of the space zone to be treated.

The features according to the invention are especially of interest when the space zone is relatively difficult of access, for example in the case where electrified powdered materials are manipulated in the course of an industrial process or when it contains an inflammable or explosive atmosphere. If the charged particles are ejected by a pipe out of the enclosure in which they are formed, it is in fact possible to avoid all contact between the external atmosphere and the interior of the enclosure by reason of the unidirectional character of the current of micro-particles and its relatively high velocity in the pipe.

The invention also has for object the application of the process and devices which have just been defined to the elimination of the static electricity of electrified bodies.

In certain cases it can occur that the body to be neutralised retains a residual charge of low value and not of such nature as to bring the potential of this object to dangerous values. If it is desired to eliminate this residual charge or fix it at a value different from that resulting from the neutralisation operation, in accordance with a supplementary aspect of the invention the electric field is detected in the vicinity of this body and the corona discharge supply circuit is made responsive to the detected field in such manner as to bring it to a sought value, for example zero.

BRIEF DESCRIPTION OF THE DRAWINGS

The following description is givein by way of example with reference to the accompanying drawings, wherein.

DESCRIPTION OF EMBODIMENTS

Figure 1:
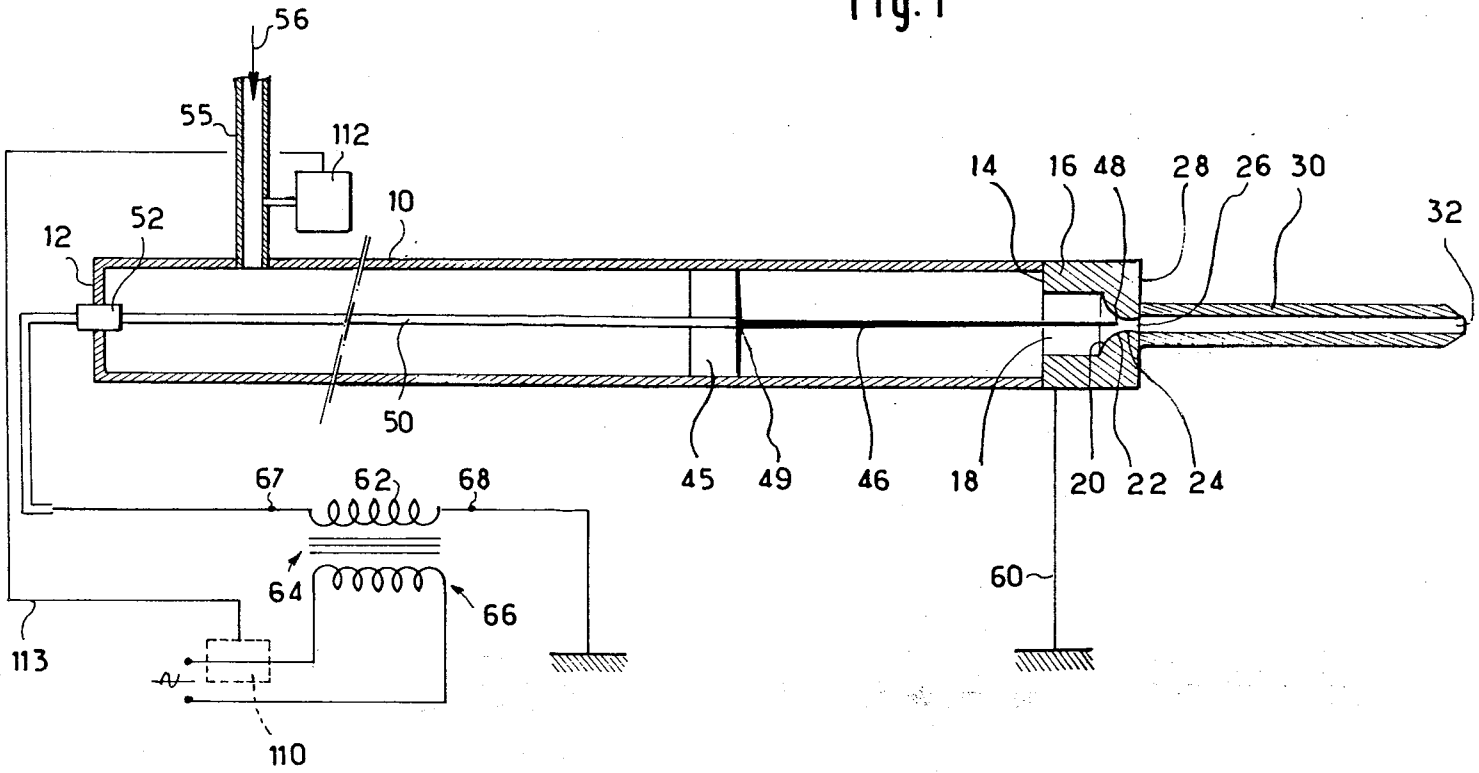
FIG. 1 is a longitudinal sectional view of a generator or injector of electric charges of opposite signs into a space zone.

An electric charge injector (FIG. 1) comprises an elongated insulating tubular body 10 closed at one end 12 and prolonged at its other extremity 14 by a body 16 of revolution the internal profile of which defines a nozzle 18 comprising a constricted part 20 followed by a neck 22 then a divergent part 24, in departure from the extremity 14 of the tubular body 10. The divergent part opens through an orifice 26 formed in the forward face 28 of the nozzle body 16 into a tube 30 coaxial with the nozzle 18, the extremity of which forms a nozzle 32 for ejection towards the exterior in the direction of a space zone.

A needle 46 of a conductive material centred on the axis of the tube 10 and comprising a point 48 at the neck 22 of the nozzle 18 is fixed within the body 10 by an insulating star fitting 45 connected to the internal wall of the cylindrical body 10. The rear extremity 49 of the needle 46 is electrically connected to a conductor 50 which passes through the end wall 12 of the body 10 by an insulating duct 52. In the posterior lateral wall of the body 10 a compressed air supply conduit 55 opens in the direction of the arrow 56.

The body 10 is constituted of an insulating material like the cap 34. In this example the nozzle body 16 is conductive and electrically connected to earth by a conductor 60, the cable 50 being connected to one extremity 67 of a high tension secondary winding 62 of a transformer 64 the primary side 66 of which is supplied by mains alternating current voltage at 220 V. The other extremity 68 of the winding 62 is earthed.

The conduit 55 is connected to a compressor (not shown) supplied with humid air for the purpose of injecting compressed humid air in the direction of the arrow 56 to the interior of the injector body 10, which air penetrates into the nozzle body 16 and commences to expand in the region of the constriction 20 where it is accelerated while cooling. From the neck 22 it acquires a supersonic speed under the acceleration effect imparted to it by the divergent part 24 of the nozzle, then penetrates into the tube 30 in order to be ejected through the orifice 32 out of the enclosure formed by the interior of the tube 10, the nozzle 18 and the tube 30.

The high voltage winding 62 applies an alternating voltage of several thousand volts, for example 20 kV., between the point 48 of the needle 46 and the nozzle 16, this voltage being sufficient to permit an alternating corona discharge to be established at the neck of this nozzle. This discharge is produced in the air current in the course of expansion thereof in the narrow space separating the point 48 from the neck of the nozzle 22 where an extremely high electric field prevails. During positive alternations a space charge is formed composed of positive gaseous ions at the periphery of the corona discharge zone, while during the negative alternations negative gaseous ions form creating a negative space charge about the discharge zone.

The compressed air admitted into the conduit 55 is super-saturated with water vapour which commences to condense as soon as the air reaches the convergent part 20 of the nozzle, in the form of micro-droplets, the gaseous ions formed in the vicinity of the point 48 forming a condensation nucleus for these droplets. Under the cooling effect accompanying the expansion through the nozzle, these micro-droplets crystallise into ice micro-particles of very small diameter (about 100 Å diameter), the temperature of the air expanded in the divergent portion being able to drop to −90° C. The fine aerosol particles charged alternately positively and negatively are entrained by the gaseous current at very high speed to the interior of the tube 30 and projected into the space zone opposite to the nozzle 32, as will be explained below.

An air flow rate suitable for such a device adapted for use as a static electricity particle eliminator can be about 20 cu.m. per hour, measured under normal temperature and pressure conditions, and the corresponding pressure in the enclosure about 5 bars. The speed of ejection of the charges to the interior of the tube 30 is about 300 m/s. The humid compressed air admitted into the pipe 55 can be obtained from ambient air provided that its relative humidity is greater than about 10%. In the case where the ambient air is very dry, a humidifier is provided at the entry of the compressor. It has been found that the indicated relative humidity corresponded to a density of ice micro-particles at the level of the neck of the nozzle largely sufficient to trap almost the whole of the ions formed by the discharge.

The ionised particle yields of the positive corona discharge and the negative corona discharge are not in general the same for a given value of the supply voltage on the secondary side 62. In practice the quantity of charges of each sign produced and the resultant current from the entraining of these charges through the tube 30 depend upon a high number of factors including the condition of the point 48, the pressure and relative humidity of the air utilised and the value of the applied tension.

The ice micro-particles entrained through the tube 30 escape the action of the electric field prevailing within the injector by virtue of their very low mobility and the high speed of the gaseous flow. These charges, after having left the nozzle 32, depart therefrom to be recuperated only at a relatively high distance by an earthed body, whereafter they are liberated as will be explained below. The tube 30 is constituted by a semi-conductive material having very high resistivity. This characteristic permits avoiding the accumulation along this tube of residual charges deposited by the current of particles in the course of its travel towards the orifice 32. Such an accumulation could in fact give rise to discharges sliding along the internal wall of the tube 30 with an appreciable loss of the current of particles arriving at the exterior of the nozzle.

The mobility of the micro-particles is less by several orders of magnitude than that of the gaseous ions. By reason of this lower mobility the probability of re-combination of charges of contrary signs in the vicinity of the emissive point where the concentration of charged particles is greatest is much less than in the case of a corona discharge without expansion into air.

Figure 2:
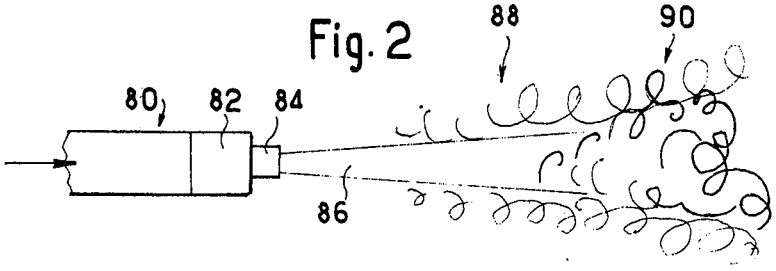
FIG. 2 illustrates diagrammatically the operation of the injector according to FIG. 1 used to raise the concentration of a space zone in electric charges of different signs.

An injector 80 (FIG. 2) is represented very diagrammatically with its nozzle 82 and an exit pipe 84 from which there projects at high speed a jet 86 of air and charged ice microcrystals which tends to become more and more turbulent as it departs from this pipe 86 towards the space zone 90 situated downstream. At several tens of centimeters downstream the ice micro-particles commence to evaporate into an intermediate zone 88, liberating the gaseous ions which they had previously trapped. In practice it has been observed that it was possible by this process to obtain high concentrations of positive and negative charges at distances of several meters from the orifice 84 before the ions thus liberated recombine.

It has however been observed that a static electricity eliminator operating in accordance with the principle recalled above with such an injector often produced only an imperfect discharge of the electrified bodies placed in the zone 90 and sometimes, in certain cases, was capable of charging these bodies with a polarity opposite to their initial polarity. These phenomena result from a disequilibrium between the concentrations of positive charges and negative charges injected into the space zone into which the body to be discharged is plunged. In fact if this disequilibrium exists in favour of charges of the same sign as those of the body to be neutralised, it is possible that all the charges carried by the body may not be neutralised before the re-combination phenomena regain the upper hand. If on the contrary the disequilibrium is in favour of the charges having a sign opposite to that of the electrified body, the latter can be discharged and then charge itself in the opposite direction.

Such a disequilibrium between the concentrations of charges transferred out of the injector results from an inequality of the outputs of the production of ions by the positive and negative successive corona discharges in the course of the alternations of the feed voltage of the electrodes constituted by the point 46 and the nozzle body 16 (FIG. 1).

This output is determined by very numerous factors on which it is difficult to act directly in order to correct the disequilibrium.

Figure 3:
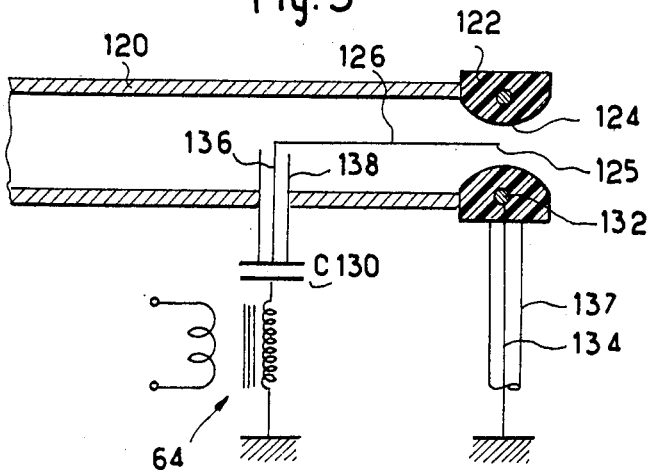
FIG. 3 represents an embodiment per the invention of the electrical assembly of an injector of the type as in FIG. 1, utilised as eliminator of static electricity charges.

It has been found that it was possible to eliminate this disequilibrium current by utilising an injector device analogous with that in FIG. 1 with a few modifications represented very diagrammatically in FIG. 3.

Thus it comprises an injector tube 120 at the extremity of which there is mounted a supersonic nozzle 122. No pipe is provided at the exit of this nozzle. At the neck 124 of the nozzle 122 there is disposed the point 125 of a needle electrode 126 which is connected to a high voltage source constituted by the transformer 64 according to FIG. 1, through the intermediary of a capacitor C 130. In departure from the embodiment according to FIG. 1, the nozzle body 122 is composed of an insulating material, for example a synthetic resin within which there is embedded a conductive ring or metallic guard ring 132 earthed through a conductor 134 which is jacketed in a lining 137 of insulating resin similar to that constituting the nozzle body 122 over at least a part of its path to earth. The needle 126 is connected to the capacitor C 130 by a conductor 136 which is itself jacketed by an insulator 138.

In operation it has been observed that the device as diagrammatically illustrated in FIG. 3, supplied with sine-wave or square-wave alternating current voltage with a peak value of 20 kV, permitted of obtaining an quasi simultaneous flow of charges of different signs at the exit of this nozzle, the overall charge of which was strictly zero.

In the application of this device to a static electricity eliminator, the flux of charged particles emitted at the exit and directed towards a space zone surrounding an electrified body to be discharged is overall neutral. Such an eliminator permits of obtaining the formation of a very strong concentration of positive and negative ionised particles into the environment of the electrified body which remains entirely equilibrated from the electrical viewpoint. The tests carried out show that then an extremely rapid complete discharge of the electrified bodies brought to potentials of several tens of thousands of volts is obtained. For example a body charged with 30 kV and placed at 3 m. from an injector supplied under the conditions described above with reference to FIG. 1 is discharged in a time of the order of one second.

Further tests have confirmed these results. Thus a metallic body which is struck by the jet at the exit of the injector according to FIG. 3 is placed in a zone corresponding to the zone 90 in FIG. 2. This body is earthed through a conductor in which there is fitted in series an ultra-sensitive galvanometer to detect the possible passage of a current. It is observed that no detectable current passes through this galvanometer, which is an indication that the balance of the charges picked up by the conductive body is effectively zero. In fact if the same experiment is repeated with an injector of the type described in FIG. 1, that is to say comprising no capacitor such as C 130 for supplying the needle 46 nor a nozzle the surface of which opposite to the point 48 of the electrode 46 is insulating, in general there is detected an appreciable continuous current due to the disequilibrium between the positive and negative charge fluxes striking the body.

In operation the insulating nozzle device according to FIG. 3 has the capacitor C 130 charging up to a relatively slight potential, namely for example a few tens of volts. If the electrified body to be discharged is placed at a relatively short distance from the ejection orifice of the injector, it is observed that it maintains a potential level at most equal to that of the point 126. This electrification potential level of the order of 500 volts is entirely without danger if it is known that the electrification potentials of the bodies which it is sought to discharge with the aid of the present invention can currently reach several tens of kilovolts. It is observed that when the body is moved away from the exit of the injector the level of this continuous potential upon the body drops very appreciably.

For certain applications it is however desired to reduce the residual potential of the body placed at a distance in order to bring it to a strictly neutral electrical level. One form of embodiment of the invention then provides supplementary means for measuring the potential of the body in relation to a reference mass and means for action upon the value of the continuous voltage of the point 126 in order to subject the electrical potential of the body to that of the reference mass.

One may try to explain the remarkable overall neutrality of the flux of electric charges transferred from the eliminator device by observing that no continuous electric current can circulate between the point 125 of the needle 126 and the nozzle body 122. The electric field at each point in space between these two elements, which causes the alternating corona discharge at the neck of the nozzle, possesses asymmetrical positive and negative alternations. The difference of amplitude between these alternations corresponds to a continuous voltage component between the terminals of the capacitor C 130. This continuous component acts like a polarisation tending to compensate the asymmetry between the charge currents produced by the alternations of opposite signs of the system. In fact it has been indicated above that the ionic production output of the corona discharges of each sign depends upon the voltage applied to the electrodes between which this discharge occurs. By the circuit according to the invention a disequilibrium is realised between the feed voltage of the positive discharge and that of the negative discharge in order automatically to equalise the outputs of particles of the two signs. At equilibrium, any continuous component which might tend to arise in the charge current transmitted by the needle 126 under the influence of a disequilibrium of these outputs is translated by an action of charging or discharging of the capacitor 130 which comes to compensate the corona discharge supply voltage in a sense tending to eliminate this disequilibrium of the charge production outputs.

If for example a disequilibrium tends to manifest itself in the sense of an increase of the current of positive ions, the result is a continuous current component in the circuit of the needle 126 tending to discharge the capacitor C 130, if the latter were charged positively. The tension at the terminals of the capacitor C 130 then tends to drop and the feed voltage of the electrodes in the course of the positive alternations likewise tends to drop, involving a reduction of the production output of positive ions, compensating the disequilibrium.

This explanation can be supplemented by considering what would occur if the surface of the nozzle, instead of being insulating, were conductive as in the case of the injector according to FIG. 1. The avalanche zone of the corona discharge then acts as a resistance between the needle 126 and the surface, which is conductive in this hypothesis, of the nozzle 122. Any disequilibrium between the positive and negative charge fluxes is translated by a current which, instead of charging or discharging the capacitor C 130 until it is cancelled, tends to circulate short-circuiting the fittings of the capacitor C 130 through the nozzle and earth.

Figure 4:
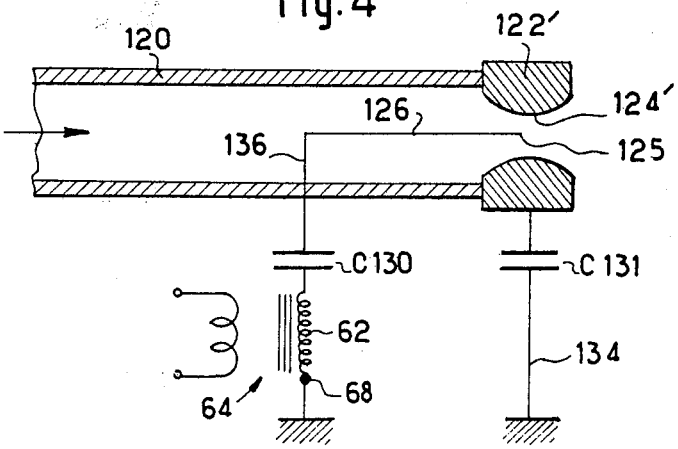
FIG. 4 represents a form of the electrical assembly of an injector.

It would then be possible to consider blocking this continuous current by placing a capacitor C 131, as represented in the diagram in FIG. 4, between a conductive nozzle 122' and earth. However experience then shows that the voltage at the terminals of the two capacitors at C 130 and C 131 tend to increase while remaining equal until they reach very high and dangerous values (several tens of kV, even 100 kV). Moreover it is observed that the electrified body to be discharged has its potential increasing in analogous proportions, which is unacceptable for an eliminator.

It is in fact possible to observe that the two capacitors C 130 and C 131 retain equal tension levels at their terminals by reason of the weakly conductive connection existing through the corona discharge. Thus the differences of the voltage between the electrodes 125 and 122 at each alternation and the causes of disequilibrium attached thereto are not modified by the capacitors C 130 and C 131.

In the form of embodiment according to FIG. 3 the insulating material on the internal surface 124 of the nozzle constitutes a resistance of infinite value between the point 125 and the conductor of the guard ring 132 (which constitutes the actual second electrode), while permitting the electric field to act. The distance between this ring 132 and the surface of the nozzle results from a compromise adapted to avoid breakdown of the said insulating covering, while permitting of obtaining a sufficient electric field and without necessitating prohibitively high voltage. The insulating layer 137 enclosing the conductor 134 is intended to prevent the establishment of stray current paths between the point 125 and the earth conductor 134. In the same manner the insulator 138 is intended to avoid the formation of stray currents between the conductor 136, charged at a continuous potential as explained, and the remainder of the body 120 of the injector.

The capacitance of the capacitor C 130 is determined at a relatively low value so as to limit its electric charge level when in operation it is brought to a polarisation potential of about several tens of volts. In fact when the corona discharge is triggered, any disequilibrium existing between the production of ions by the positive and negative alternations creates a continuous current which is progressively attenuated, charging the capacitor C 130, until the fluxes of negative and positive charges are equal. A part of this continuous current strikes the electrified body to be discharged and can impart to it a possible residual charge at maximum equal to that acquired by the capacitor C 130. It is preferable to adopt a relatively low capacitance value for this latter capacitor in order to limit the possible residual charge of the electrified body. Experience shows that in practice this can be limited to a few hundred pF.

Figure 5:
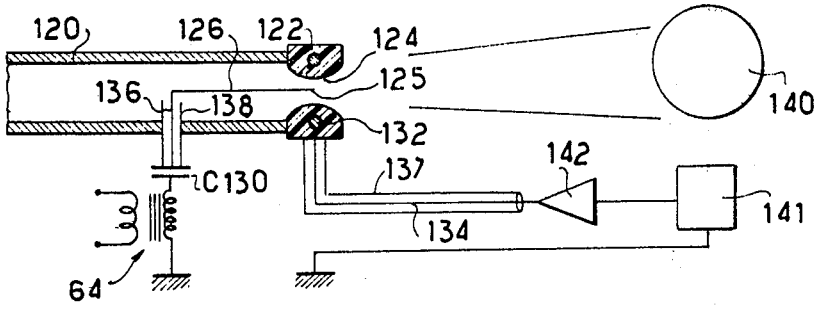
FIG. 5 represents a first variant of embodiment of the electrical assembly of an injector utilised as static electricity eliminator.
Figure 6:
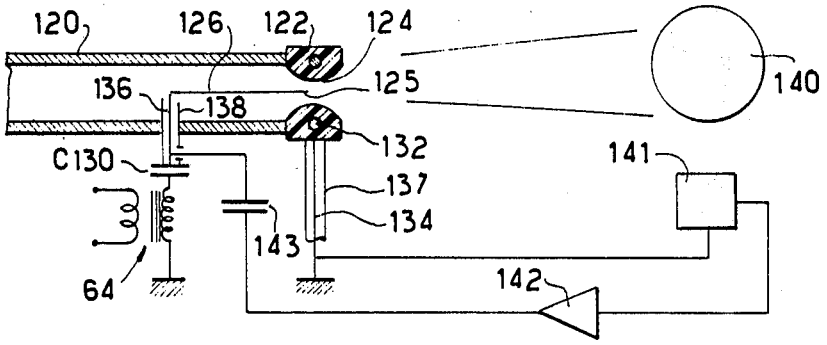
FIG. 6 represents a second variant of embodiment of the electrical assembly.
Figure 7:
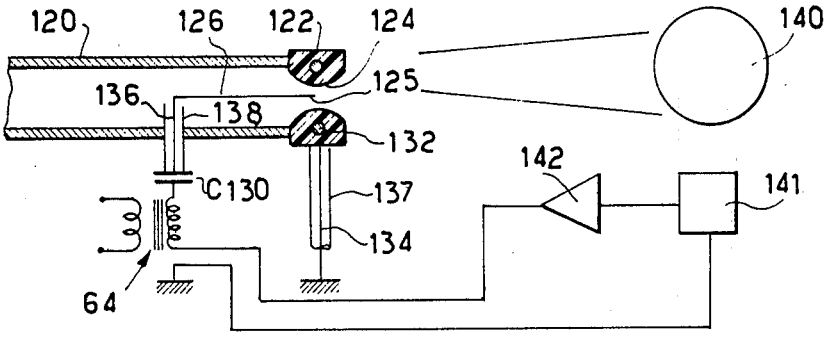
FIG. 7 represents a third variant of embodiment.
Figure 8:
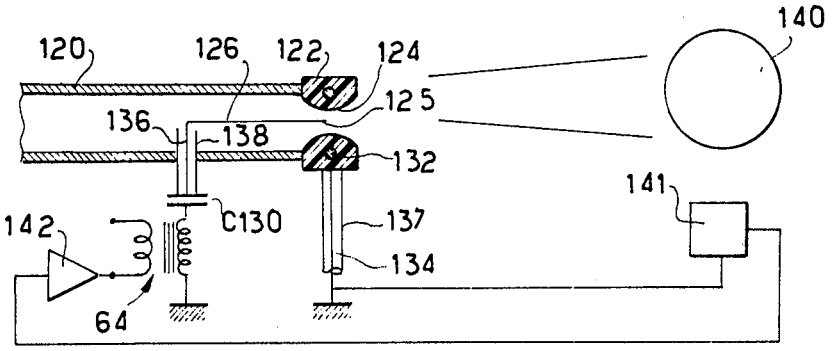
FIG. 8 represents another variant of the electrical assembly.

For applications in which it is desired to terminate at a strictly neutral electrical state of the body, the residual charge is eliminated by means of an electronic device comprising means for measuring the electrical potential of the body and means for acting upon the potential of the point 126 in relation to the reference mass. The electrical potential of the body 140 (FIG. 5) is measured by means of a known electric field-measuring apparatus 141 connected to the reference mass, and the signal produced as utilised to modify the potential in relation to the mass of the point 126 in order to bring the body 140 to the electrically neutral condition, or maintain it there. To this end an amplifier 142, connected to the output of the apparatus 141, delivers a continuous voltage which is opposite in sign to the residual potential of the body 140 and which is applied either to the ring (FIG. 5) or to the end of the secondary winding of the transformer 64 (FIG. 7) or to the entry of a coupling capacitor 143 the output of which is connected to the point 126 (FIG. 6). By way of variant (FIG. 8) the signal delivered by the amplifier 142 compels a variation of the amplitude of the alternating voltage which is applied to the primary winding of the transformer 64.

A device such as that as just described offers the possibility of transporting a flux of electric charges of different signs over relatively great distances (several meters), which as explained above can be of interest in certain applications to static electricity eliminators, especially for bodies in diffused or powdered form. Moreover by reason simultaneously of this great distance and especially of the fact that the interior of the enclosure defined by the body of the injector is practically isolated from the space zone considered by the gaseous jet escaping therefrom, there is no fear of any risk of contact between an explosive atmosphere in this space zone and the corona discharge within this enclosure.

In accordance with a supplementary characteristic of the invention it may further be proposed to establish a circuit breaker 110 (FIG. 1) in the electric supply circuit of the corona discharge device which operates in response to the output signal 113 of a pressure-responsive device 112 placed on the supply conduit 55 of the compressed air injector. In this manner the electrodes adapted to produce the corona discharge can be energised only when the compressed air is admitted into the injector and escapes therefrom at high speed through the orifice 32. Moreover no electric arc can be established between the metallic point such as 125 and earth, by means of the insulating nozzle.

It has further been observed that with injectors of the above-described type surprisingly there was practically no liberation of ozone into the atmosphere outside the eliminator, which has advantages in certain applications.

Finally and essentially the device the principle of which is represented diagrammatically in FIG. 3 permits of obtaining an extremely rapid elimination of the electrostatic discharges of a body to be neutralised in order to bring them to a potential level which is without danger.

I claim:

1. An apparatus for introducing bipolar charges into a region of space, comprising:

an enclosure;

means adapted to feed said enclosure with a pressurized gas, charged with a substance adapted to change phase by cooling when said gas is caused to expand;

a body arranged in said enclosure for defining a nozzle to the exterior, said body comprising an electrically conducting member close to said nozzle, and the surface of said nozzle being electrically insulating;

a tapered electrode, the apex of which is situated close to the neck of the nozzle;

means for applying an AC high voltage between said electrically conducting member and said tapered electrode, said means for applying comprising a capacitor in series, thereby producing a corona discharge between said apex of the tapered electrode and said nozzle;

whereby the gas is ionized with bipolar charges substantially equilibrating each other, and then expands past the nozzle, while said substance changes phase and carries said equilibrating bipolar charges over a distance to a region of space.

2. The apparatus of claim 1 wherein said body is of insulating material in which said electrically conducting member is embedded.

3. The apparatus of claim 12 wherein said electrically conducting member is an annular metallic ring coaxial with the said nozzle.

4. The apparatus of claim 1 wherein said means for applying an AC high voltage comprises an AC high voltage source, first means for connecting one terminal of the AC source to said tapered electrode through a series capacitor, the other terminal of the AC source being connected to ground, and second means for connecting said electrically conducting member to ground.

5. The apparatus of claim 4 wherein the first means for connecting comprises a conductor insulated over at least a part of its length from the tapered electrode.

6. The apparatus of claim 4 wherein the second means for connecting comprises a conductor insulated over at least a part of its length from the nozzle body.

7. The apparatus of claim 4 further comprising means for sensing the electrical potential of a body lying in a portion of said space zone, and means for generating a compensating DC voltage having a polarity opposite to that of the sensed electrical potential, and for applying the DC voltage to said means for applying an AC high voltage.

8. The apparatus of claim 7 wherein said compensating DC voltage is coupled to said tapered electrode via another capacitor.

9. The apparatus of claim 7 wherein said compensating DC voltage is coupled in series between said electrically conductive member and the ground.

10. The apparatus of claim 7 wherein said compensating DC voltage is coupled to said AC high voltage source for varying the amplitude thereof.

11. The apparatus of any of claims 1 to 7, further comprising a tubular ejector at the nozzle outlet to eject the expanded gas from the enclosure.

* * * * *